United States Patent [19]

Kolakowski et al.

[11] Patent Number: 4,635,702

[45] Date of Patent: Jan. 13, 1987

[54] MOLD FOR CONTINUOUS CASTING OF STEEL STRIP

[75] Inventors: Manfred Kolakowski; Hans Streubel, both of Erkrath, Fed. Rep. of Germany

[73] Assignee: SMS Schloemann-Siemag AG, Dusseldorf, Fed. Rep. of Germany

[21] Appl. No.: 682,602

[22] Filed: Dec. 17, 1984

[30] Foreign Application Priority Data

Jan. 5, 1984 [DE] Fed. Rep. of Germany ..... 3400220

[51] Int. Cl.[4] ..... B22D 7/00

[52] U.S. Cl. ..... 164/418; 164/435

[58] Field of Search ..... 164/418, 436, 424, 435, 164/491

[56] References Cited

U.S. PATENT DOCUMENTS

| | | | |
|---|---|---|---|
| 4,134,441 | 1/1979 | Ohmari | 164/418 |
| 4,363,352 | 12/1982 | Pryor | 164/418 |

FOREIGN PATENT DOCUMENTS

| | | | |
|---|---|---|---|
| 887990 | 9/1953 | Fed. Rep. of Germany . | |
| 1910902 | 12/1970 | Fed. Rep. of Germany | 164/443 |
| 54-5825 | 1/1979 | Japan | 164/418 |
| 143215 | 11/1961 | U.S.S.R. | 164/418 |
| 859018 | 8/1981 | U.S.S.R. | 164/418 |
| 850280 | 8/1981 | U.S.S.R. | 164/418 |

*Primary Examiner*—Nicholas P. Godici
*Assistant Examiner*—G. M. Reid
*Attorney, Agent, or Firm*—Karl F. Ross; Herbert Dubno

[57] ABSTRACT

A mold has two broad side walls opposing each other at a distance and being connected to two narrow walls which oppose each other and are arranged between the side walls. The upper portion of the side walls defines a funnel-shaped casting area whereby the narrow walls are arranged beyond the casting area so that the side walls extend parallel towards the narrow walls at the distance which corresponds to the width of the cast steel.

10 Claims, 6 Drawing Figures

MOLD FOR CONTINUOUS CASTING OF STEEL STRIP

FIELD OF THE INVENTION

Our present invention relates to a mold for and method of continuous casting of steel strip i.e. continuous castings which generally have a thickness below about 60 mm.

BACKGROUND OF THE INVENTION

In the German Pat. No. 887 990 slot-shaped casting mold is disclosed including two cooled broad walls and two narrow side walls which are also cooled. The broad walls extend parallel to each other and each has an upper portion which expands outwardly away from the other so that a funnel-shaped chamber is defined which converges downwardly and is reduced to the shape of the casting in the casting direction.

This known mold has the disadvantage that the casting shell solidifies in the area of the front walls in a trapezoidal pattern. In view of the constriction of the mold, the trapezoidal solidification results in a jamming of the billet and thus to a tearing of the casting shell, i.e. the shell of metal hardening around a molten core. This prior art mold was therefore unsuitable for casting steel strip.

OBJECTS OF THE INVENTION

It is thus the principal object of our invention to provide an improved mold for casting steel strip obviating the aforestated drawbacks and producing steel strip with unobjectionable structure and high surface quality.

Another object is to provide an improved method of continuously casting steel strip.

SUMMARY OF THE INVENTION

These objects are realized, in accordance with the present invention, by providing a pair of opposing broad walls having an upper portion defining a funnel-shaped casting area with a pair of opposing narrow walls arranged between the broad walls and flanking the casting area. According to the invention the broad walls outwardly and below the funnel shaped casting area, which converges in the casting direction, extend parallel to one another at the spacing of the outlet slot of the mold, i.e. a spacing substantially equal to the thickness of the steel strip produced.

Through the provision of the invention, a trapezoidal solidification is prevented in the area of the inclined broad walls and the formation of a casting shell within the parallel extensions of the broad walls adjacent to the narrow walls cannot lead to a jamming.

In a method of casting steel strip with the mold of the invention with a thickness less than 60 mm, the rate of cooling of the walls of the mold and the speed with which the steel is drawn off from the mold are selected such that the casting shell has a thickness of less than 6 mm at the lower end of the funnel-shaped casting area. Advantageously, the drawoff speed is at least 3 m/min, preferably 4–6 m/min.

According to a feature of the invention, one or each of the narrow walls is formed as a cooled bar which is shiftable transversely to itself to allow the width of the cast strip to be varied.

Since the casting shell is stressed at the angle made by the flanks of the funnel portion with the parallel faces of the extensions of the broad surfaces, we prefer to keep this angle $\alpha$ below 10° and to round the transitions between the funnel flanks and these extensions.

Advantageously means is provided to lubricate the broad walls at least in their parallel regions, i.e. the regions of the extensions. The upper portion of the mold can have advantageously a lower thermal conductivity than the remainder thereof; this can be achieved by making the mold thicker at the upper portion or by selection of material. For example an iron-copper alloy can be used to fabricate the mold with the proportion of iron in the alloy being greater where reduced thermal conductivity and increased refractoriness is desired. The ingot mold walls should have a conductivity of at most that of the ingot mold copper usually used, i.e. the alloy which is employed has a thermal conductivity at most one half that of copper.

BRIEF DESCRIPTION OF THE DRAWING

The above and other features of our present invention will now be described in detail with reference to the accompanying drawing in which.

SPECIFIC DESCRIPTION

Figure 1:
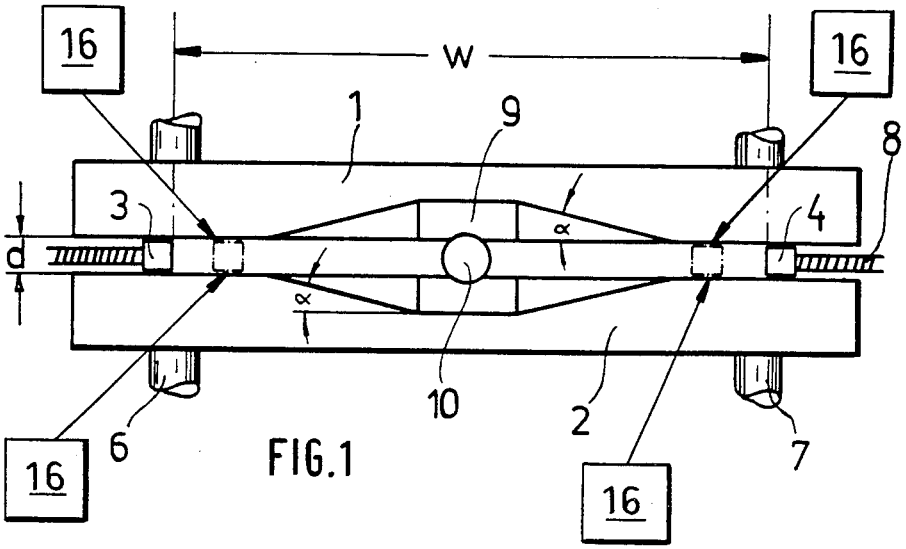
FIG. 1 is a top view of a mold according to the invention.
Figure 2:
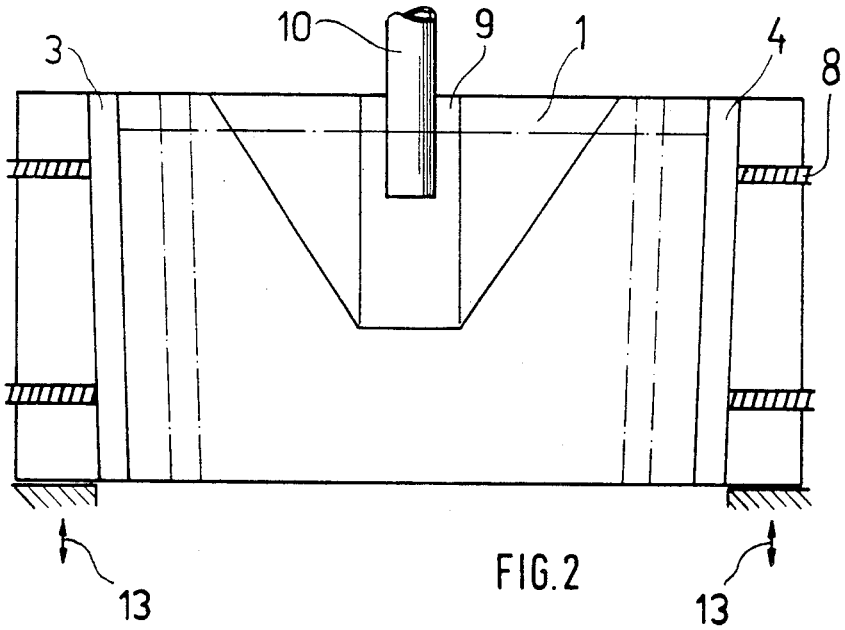
FIG. 2 is a longitudinal section of the mold in FIG. 1.

In the drawing, we show a mold for the continuous casting of steel strip, including two opposing broad side walls 1, 2 extending parallel to each other at a distance d which corresponds to the thickness of the cast steel strip.

Between the broad side walls 1, 2 and arranged therebetween at a distance to each other are two parallel narrow walls 3, 4 which oppose each other and have a depth corresponding to the distance d which is considerably smaller than the width w of the side walls 1, 2 between the narrow walls 3, 4.

For providing a cooling effect, the broad side walls 1, 2 are provided with hollow spaces 5 which are in communication with supply and discharge lines 6, 7 for a coolant. The narrow side walls 3, 4 are also equipped with a cooling system and each is formed as a bar which can be moved by means of threaded spindles 8. Accordingly, the distance between the front walls 3, 4 and thus the width of the steel strip to be produced is adjustable by moving the front walls 3, 4 toward each other or apart from each other. We may note that the adjustment of the front walls 3, 4 is feasible even during casting.

Connected to the mold is an oscillation device which provides periodical upward and downward movements to enhance the heat transfer and prevents the formed casting shell 12 from clinging to the walls of the mold thereby interrupting the shell. The oscillation device is generally characterized by arrows 13 and not described or depicted in detail as any known ingot mold oscillating device is suitable.

Figure 3:
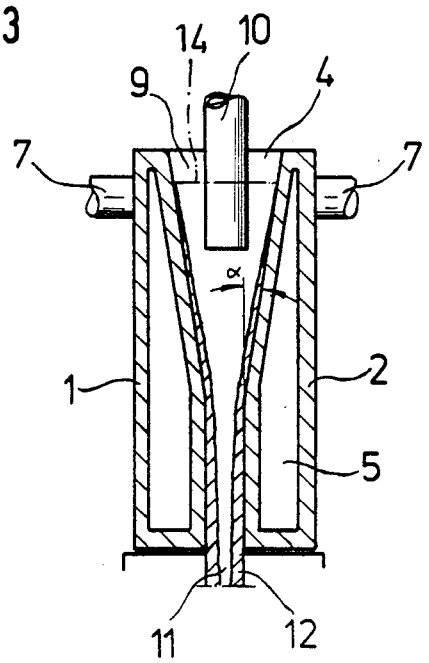
FIG. 3 is a cross-sectional view through the mold.

As is particularly shown in FIG. 3, the side walls 1, 2, have each an upper portion which opens outwardly so that a funnel-shaped chamber or casting area 9 is defined. Since the side walls are spaced at the distance d, the chamber 9 converges at its lower section up to a width corresponding to the distance d and the width of the cast steel strip. Into the chamber 9, liquid steel 11 is fed through a feed pipe 10 which projects into the chamber 9 such that it is immersed in the molten steel 11 whose upper level is represented by dash-dot line 14.

Figure 4:
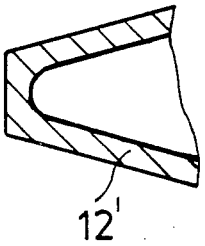
FIG. 4 shows a trapezoidal solidification of the respective section of a steel strip according to the prior art.
Figure 5:
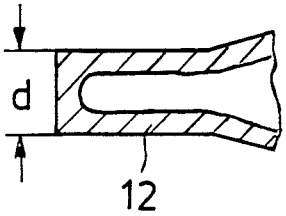
PRIOR ART FIG.5
FIG. 5 shows a rectangular solidification of the respective section of the steel strip according to the invention.

FIG. 1 shows that the funnel-shape of the upper portion does not extend over the entire width of the broad side walls 1, 2 but extends short of the narrow walls 3, 4 so that the broad side walls 1, 2 are arranged or extend parallel to each other in vicinity of the narrow walls 3, 4. Consequently, when feeding or pouring in liquid steel through the pipe 10, the casting shell 12 will solidify in a rectangular shape in the area of the narrow walls 3, 4 as depicted in FIG. 5 and not in the disadvantageous trapezoidal configuration as shown in FIG. 4 by reference numeral 12' and disclosed in the German Pat. No. 887 990. It is preferred to provide the parallel arrangement of the side walls 1, 2 beyond the funnel-shaped chamber 9 of a width which corresponds at least to the thickness d of the cast strip and preferably at least several times this thickness.

Figure 6:
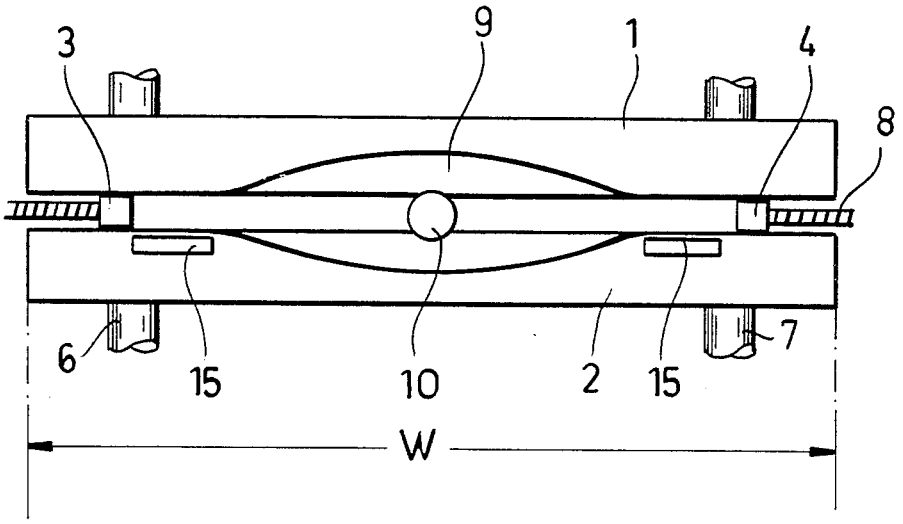
FIG. 6 is a top view of a mold similar to that shown in FIG. 1.

The casting shell 12 solidifying in the chamber 9 is reduced and formed to the width d when being transferred into the lower portions of the broad side walls 1, 2 which lower portions extend parallel to each other at the distance d and is drawn off therefrom. Since the casting shell 12 is subjected to a bending strain during the reduction of the funnel-shaped chamber 9 to the rectangular section as defined by the parallel lower portions of the side walls 1, 2, the angle of inclination $\alpha$ is held smaller than 10° as measured relative to a horizontal axis and a vertical axis and between adjoining planes in order to limit the bending strain. A further reduction of the bending strain is obtained when providing the casting area 9 in a curved manner or at least partly in a curved manner (FIG. 6) at least at transitions between adjoining surfaces.

Since the upper portion of the walls of the mold, that is broad side walls 1, 2 and narrow walls 3, 4 are subjected to a higher temperature as the liquid steel 11 is introduced at this area, we provide a lower thermal conductivity of the upper portion in comparison to the lower portion. It is, however, also possible to provide the mold walls 1, 2, 3, 4 entirely of a material having a heat conductivity of at most 50% of the copper of the mold. In addition to the oscillation device 13, the side walls 1, 2 can be associated with a lubrication system 16 in the area adjacent to the front walls 3, 4 that is the area along which the upper portion of the side walls 1, 2 extend parallel to each other.

When producing steel strip, the liquid steel is introduced through the pipe 10 into the chamber 9 where the steel solidifies along the walls. For casting steel bands below 60 mm thickness, the cooling speed i.e. the supply of coolant through the hollow spaces 5 and the speed with which the steel band is drawn off from the mold is determined in such a manner that the casting shell has a thickness of less than 6 mm at the end of the funnel-shaped section that is at the junction to the rectangular section whereby the drawoff speed is at least 3 m/min, preferably 4–6 m/min.

In order to control the solidification of liquid steel 11 at the parallel extension of the side walls 1, 2 adjacent to the front walls 3, 4, a heating unit 15 is provided in the side walls 1, 2.

We claim:

1. A mold for continuously casting steel strip comprising:

a pair of broad side walls juxtaposed spacedly with one another and formed with upper portions expanding outwardly to provide a downwardly converging funnel-shaped casting area; and a pair of narrow walls opposing each other and arranged between said broad side walls laterally outwardly of said funnel-shaped casting area, said mold possessing a pair of extension portions, said extension portions being spaces between the narrow walls and the funnel-shaped casting area and the pair of broad side walls, wherein the distance between the narrow walls and the funnel-shaped area is at least equal to the distance between the two broad side walls in the area of the extension portions, said broad side walls being further formed with lower portions extending parallel to one another at a spacing corresponding to the width of an outlet slot of said mold, from said downwardly converging funnel-shaped casting area to said outlet slot.

2. A mold as defined in claim 1 wherein the portions of said broad side walls extending parallel to each other and toward said narrow walls have widths at least corresponding to said spacing.

3. A mold as defined in claim 1 wherein said funnel-shaped casting area has surfaces adjoining said parallel portions including angles of less than 10°.

4. A mold as defined in claim 1 wherein said funnel-shaped casting area is at least partly provided by curved surfaces.

5. A mold as defined in claim 1 further comprising lubricating means for said broad side walls at said parallel portions for preventing clinging of solidified steel onto said walls.

6. A mold as defined in claim 1, further comprising heating means for said broad side walls at said parallel portions for controlling solidification of the steel.

7. A mold as defined in claim 1 wherein said broad side walls and said narrow walls include each an upper section and a lower section, said upper section having a lower thermal conductivity than said lower section.

8. A mold as defined in claim 1 wherein said broad side walls and said narrow walls are made of a material having a heat conductivity of at most 50% of copper.

9. A mold as defined in claim 1, further comprising driving means for moving said narrow walls towards each other and apart from each other.

10. A mold as defined in claim 1, further comprising oscillating means for vertically reciprocating the mold.

* * * * *

UNITED STATES PATENT AND TRADEMARK OFFICE

CERTIFICATE OF CORRECTION

PATENT NO. : B1 4,635,702

DATED : April 16, 1996

INVENTOR(S) : Kolakowski et al.

It is certified that error appears in the above-indentified patent and that said Letters Patent is hereby corrected as shown below:

On the title page: Item

[56], all the following references under "FOREIGN PATENT DOCUMENTS":

| | | |
|---|---|---|
| 322756 | 06/10/75 | Austria |
| 360189 | 12/29/80 | Austria |
| 295064 | 12/27/71 | Austria |
| 23 10 615 | 09/20/73 | Germany |
| 58-86906 | 05/24/83 | Japan |
| 55-130362 | 10/09/80 | Japan |
| 58-218353 | 12/19/83 | Japan |
| 59-104251 | 06/16/84 | Japan |
| 59-185548 | 10/22/84 | Japan |

Title page: Column 2,

Under "Primary Examiner - Kuang Y. Lin" add Attorney, Agent or Firm - KARL F. ROSS, P.C., Herbert Dubno, James C. Lydon, Peter B. Martine Signed and Sealed this Twelfth Day of November, 1996

*Attest:*

Bruce Lehman

BRUCE LEHMAN

*Attesting Officer*

*Commissioner of Patents and Trademarks*

US004635702B1

REEXAMINATION CERTIFICATE (2844th)

United States Patent [19]

Kolakowski et al.

[11] B1 4,635,702

[45] Certificate Issued Apr. 16, 1996

[54] MOLD FOR CONTINUOUS CASTING OF STEEL STRIP

[75] Inventors: Manfred Kolakowski; Hans Streubel, both of Erkrath, Germany

[73] Assignee: SMS Schloemann-Siemag AG, Dusseldorf, Germany

Reexamination Requests:
No. 90/003,664, Dec. 19, 1994
No. 90/003,747, Mar. 13, 1995

Reexamination Certificate for:

| | |
|---|---|
| Patent No.: | **4,635,702** |
| Issued: | **Jan. 13, 1987** |
| Appl. No.: | **682,602** |
| Filed: | **Dec. 17, 1984** |

[30] Foreign Application Priority Data

Jan. 5, 1984 [DE] Germany ..... 3400220

[51] Int. Cl.[6] ..... B22D 11/00; B22D 11/04

[52] U.S. Cl. ..... 164/418; 164/436; 164/338.1; 164/435

[58] Field of Search ..... 164/418, 459, 164/436, 491, 268, 472, 338.1, 416, 478

[56] References Cited

U.S. PATENT DOCUMENTS

| | | | |
|---|---|---|---|
| 2,564,723 | 8/1951 | Rossi . | |
| 3,520,352 | 7/1970 | Hess | 164/283 |
| 3,837,391 | 9/1974 | Rossi | 164/282 |
| 3,837,392 | 9/1974 | Rossi | 164/282 |
| 4,134,441 | 1/1979 | Ohmori et al. . | |
| 4,363,352 | 12/1982 | Pryor et al. . | |

FOREIGN PATENT DOCUMENTS

| | | |
|---|---|---|
| 0114293B1 | 8/1984 | European Pat. Off. . |
| 2243043 | 4/1975 | France . |
| 887990 | 9/1953 | Germany . |
| 1254828 | 11/1967 | Germany . |
| 1910902 | 12/1970 | Germany . |
| 2034762 | 1/1972 | Germany . |
| 2415224 | 10/1974 | Germany . |
| 2743026 | 3/1978 | Germany . |
| 51-112730 | 10/1976 | Japan . |
| 54-5825 | 1/1979 | Japan . |
| 58-97466 | 6/1983 | Japan . |
| 143215 | 11/1961 | U.S.S.R. . |
| 850280 | 8/1981 | U.S.S.R. . |
| 859018 | 8/1981 | U.S.S.R. . |
| 1199805 | 7/1970 | United Kingdom . |

OTHER PUBLICATIONS

"Stahlstrang–Giessanlagen," H. G. Baumann (1976).

U. Petersen et al., "The Development of the Continuous Casting of Steel and its Industrial Application", 86 *Stahl u. Eisen* 333 (1966).

Samarasekera et al., "The Thermal Field in Continuous Casting Moulds" 18 *Canadian Metallurgical Quart.* 251 (1979).

Tetsu–to–Hagane, "Change of the Width of a Piece to be Molded While Casting is Being Conducted by a Continuous Casting Machine for a Slab", 63 *J. Iron and Steel Institute of Japan* 89 (1977).

Herrmann et al., *Handbook on Continuous Casting* (1980).

Singh et al., "Heat Transfer and Skin Formation in a Continuous–Casting Mold as a Function of Steel Carbon Content" *Journal of Metals* 17 (1974).

Inouye et al., "Heat Transfer in the Continuous Casting Mold" *Nippon Steel Technical Report* No. 12 (Dec. 1978).

Alberny et al., "la lingotière de coulèe continue de brames et son bilan thermique," *Revue de Metallurgie* 545 (1976) (with English translation attached).

(List continued on next page.)

*Primary Examiner*—Kuang Y. Lin

[57] ABSTRACT

A mold has two broad side walls opposing each other at a distance and being connected to two narrow walls which oppose each other and are arranged between the side walls. The upper portion of the side walls defines a funnel-shaped casting area whereby the narrow walls are arranged beyond the casting area so that the side walls extend parallel towards the narrow walls at the distance which corresponds to the width of the cast steel.

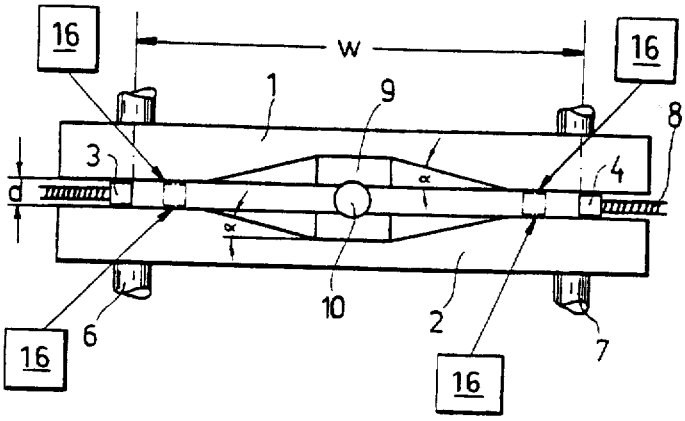

OTHER PUBLICATIONS

Palmaers et al., "Calculation of the Mechanical And Thermal Stresses In Continuously Cast Strands," 99 *Stahl u. Eisen* 1039 (1979).

H. Schrewe, "Das Stranggiessen von Breiten Brammen", *Klepzig Fachberichte* 595–97 (1968).

K. Wünnenberg, "Strand Bulging Between Supporting Rollers During Continuous Slab Casting", 98 *Stahl u. Eisen* 254 (1978).

K. Wünnenberg, "Untersuchungen an einger Brammenkokille mit Breitenverstellung während des Stranggiessens", 102 *Stahl u. Eisen* 657 (1982).

Yamahiro et al., "Variable Width Molds In Continuous Casting", 67 *Hearth Proc.* 182 (1979).

Omari et al., "Slab Width Change During Continuous Casting", *Kawasaki Steel Technical Report* 27 (Sep. 1980).

Matsui et al., "The Optimum Slab Width Changing Method", *Proc. 106th ISIJ Meeting* 275 (Oct 1983).

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2 lines 48–58:

For providing a cooling effect, the broad side walls 1, 2 are provided with hollow spaces 5 which are in communication with supply and discharge lines 6, 7 for a collant. The narrow [side] walls 3, 4 are also equipped with a cooling system and each is formed as a bar which can be move by means of threaded spindles 8. Accordingly, the distance between the [front] *narrow* walls 3, 4 and thus the width of the steel strip to be produced is adjustable by moving the [front] *narrow* walls 3, 4 toward each other or apart from each other. We may note that the adjustment of the [front] *narrow* walls 3, 4 is feasible even during casting.

Column 3, lines 25–40:

The casting shell 12 solidifying in the chamber 9 is reduced and formed to the [width] *thickness* d when being transferred into the lower portions of the broad side walls 1, 2 which lower portions extend parallel to each other at the distance d and is drawn off therefrom. Since the casting shell 12 is subjected to a bending strain during the reduction of the funnel-shaped chamber 9 to the rectangular section as defined by the parallel lower portions of the side walls 1, 2, the angle of inclination $\alpha$ is held smaller the 10° as measured relative to a horizontal axis and a vertical axis and between adjoining planes in order to limit the bending strain. A further reduction of the bending strain is obtained when providing the casting area 9 in a curved manner or at least partly in a curved manner (FIG. 5) at least at transitions between adjoining surfaces.

Column 3, lines 41–53:

Since the upper portion of the walls of the mold, that is broad side walls 1, 2 and narrow walls 3, 4 are subjected to a higher temperature as the liquid steel 11 is introduced at this area, we provide a lower thermal conductivity of the upper portion in comparison to the lower portion. It is, however, also possible to provide the mold walls 1, 2, 3, 4 entirely of a material having a heat conductivity of at most 50% of the copper of the mold. In addition to the oscillation device 13, the side walls 1, 2 can be associated with a lubrication system 16 in the area adjacent to the [front] *narrow* walls 3, 4 that is the area along which the upper portion of the side walls 1, 2 extend parallel to each other.

Column 4, lines 4–7:

In order to control the solidification of liquid steel 11 at the parallel extension of the side walls 1, 2 adjacent to the [front] *narrow* walls 3, 4, a heating unit 15 is provided in the side walls 1, 2.

AS A RESULT OF REEXAMINATION, IT HAS BEEN DETERMINED THAT:

The patentability of claims 1 and 3–10 is confirmed.

Claim 2 is cancelled.

* * * * *